US005810224A

United States Patent [19]

Simons

[11] Patent Number: 5,810,224

[45] Date of Patent: Sep. 22, 1998

[54] MARCHING RACK FOR PERCUSSION INSTRUMENTS

[75] Inventor: Richard Simons, Garfield, N.J.

[73] Assignee: Latin Percussion, Inc., Garfield, N.J.

[21] Appl. No.: 769,714

[22] Filed: Dec. 18, 1996

Related U.S. Application Data

[60] Provisional application No. 60/008,740 Dec. 18, 1995.

[51] Int. Cl.[6] ..... A45F 5/00

[52] U.S. Cl. ..... 224/270; 224/265; 224/272; 224/910; 84/421; D17/22; D3/204

[58] Field of Search ..... 224/259, 260, 224/261, 262, 263, 265, 266, 270, 271, 272, 910; 84/421; D17/22, 99, 6; D3/201, 204

[56] References Cited

U.S. PATENT DOCUMENTS

| | | | |
|---|---|---|---|
| 2,854,880 | 10/1958 | Waters | 84/421 |
| 3,021,744 | 2/1962 | Kester | D17/22 |
| 3,106,123 | 10/1963 | Johannsen | 84/421 |
| 3,282,483 | 11/1966 | Babcock | 224/262 |
| 3,774,823 | 11/1973 | Hoellerich | 224/910 |
| 3,893,363 | 7/1975 | Cohen | 84/421 |
| 3,974,732 | 8/1976 | Kester, Jr. | 224/261 |
| 4,256,007 | 3/1981 | Streit | 224/910 |
| 4,387,839 | 6/1983 | Dranchak | 224/910 |
| 4,402,441 | 9/1983 | Jones et al. | 224/270 |
| 4,450,993 | 5/1984 | Ephraim | 224/272 |
| 4,605,144 | 8/1986 | LaFlame | 224/270 |
| 4,634,032 | 1/1987 | LaFlame | 224/910 |
| 5,573,158 | 11/1996 | Penn | 224/910 |

*Primary Examiner*—Allan N. Shoap
*Assistant Examiner*—Gregory Vidovich
*Attorney, Agent, or Firm*—Baker & Botts, LLP

[57] ABSTRACT

A marching rack for percussion instruments includes a bow-shaped horizontal frame member having spaced instrument mounting brackets. The frame member is connected to an outer end of a support member having upper and lower arms. The support member is arranged to be connected to a support harness to be worn by a percussionist.

6 Claims, 2 Drawing Sheets

MARCHING RACK FOR PERCUSSION INSTRUMENTS

SPECIFICATION

This application is based upon and claims the invention described in U.S. Provisional application Ser. No. 60/008,740, filed Dec. 18, 1995.

BACKGROUND OF THE INVENTION

The present invention relates to racks for mounting percussion instruments to a harness for use by a percussionist in a marching band. In particular the apparatus of the invention provides the capability for mounting a plurality of percussion instruments, such as cymbals, wood blocks, cowbells, miniature timbales, agogos, etc. in a position where they are available to be played by a percussionist while marching.

SUMMARY OF THE INVENTION

In accordance with the invention there is provided a marching rack for percussion instruments which includes a bow-shaped frame member having a plurality of instrument mounting members spaced therealong. The bow-shaped frame member is centrally connected to a support member having first and second vertically spaced support arms and at least one connecting member for connection to a support harness. The support member has an outer end arranged to be connected to the central portion of the frame member to hold the frame in a horizontal orientation.

In one embodiment the first and second support arms each include a connecting member for connection to the support harness. In a second embodiment the first and second support arms are joined to a common connecting member, which preferably comprises a flange having vertically spaced tubes mounted thereon.

For a better understanding of the present invention, together with other and further embodiments, reference is made to the following description, taken in conjunction with the accompanying drawings, and its scope will be pointed out in the appended claims.

DESCRIPTION OF THE INVENTION

Figure 1:
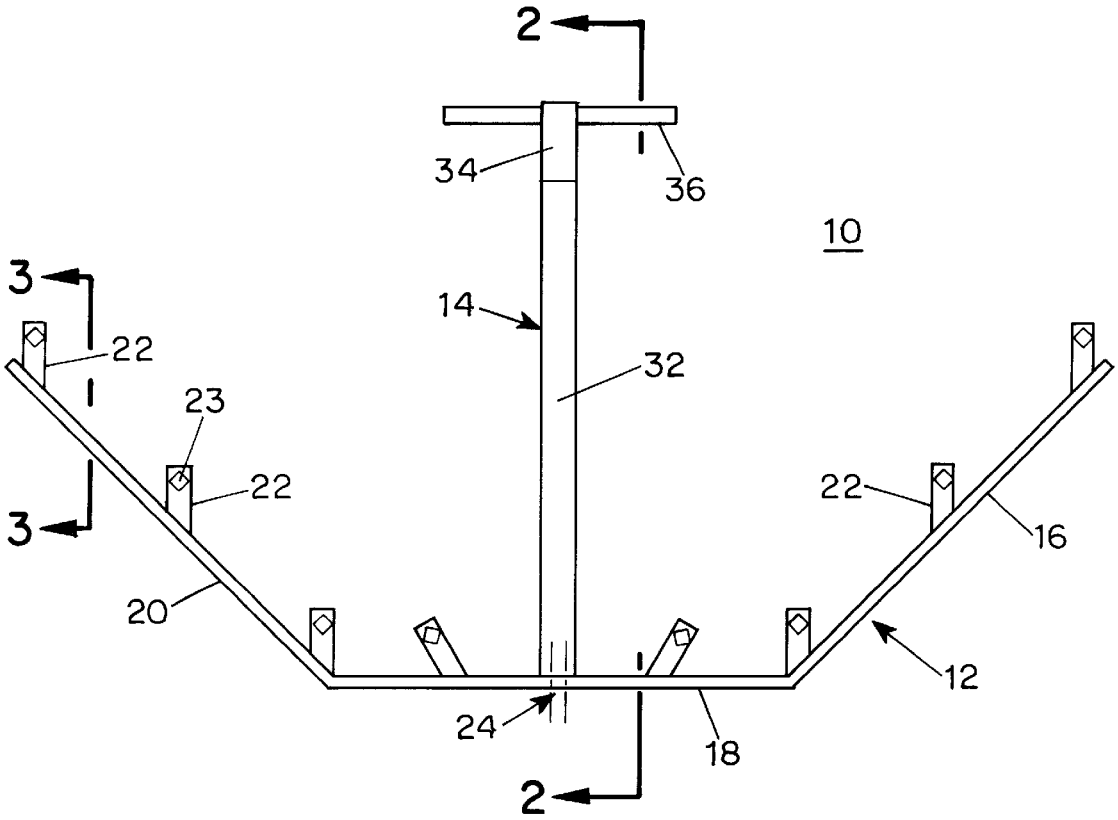
FIG. 1 is a top view of a marching rack in accordance with the present invention.

A marching rack 10 according to the present invention is shown in a top view in FIG. 1. The marching rack 10 includes a bow-shaped mounting frame 12 and a support member 14. In the FIG. 1 embodiment mounting frame 12 includes a central section 18 and side sections 16 and 20, each of which is approximately twelve inches in length and fabricated of ¼" by 1" steel. Side sections 16 and 18 are arranged at a 45° angle with respect to central member 20 to form bow-shaped frame 12. Alternately, the bow-shaped frame can be formed by bending frame 12 into a continuous curve. A plurality of instrument mounting members 22 are arranged along mounting frame 12 for supporting a number of instruments in positions wherein they can easily be reached by the percussionist for play. Mounting frame 12 is connected to support member 14 by bolts which pass through bores 24 at the center of mounting frame 12 and engage a flange 30 of support 14.

Figure 2:
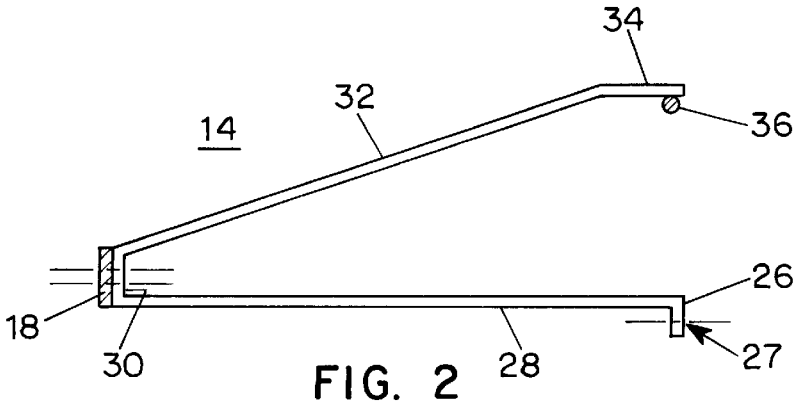
FIG. 2 is a cross-sectional view of the FIG. 1 marching rack showing the support member.

FIG. 2 is a cross-sectional view of the FIG. 1 marching rack, showing support member 14 in side view. Portions of marching rack 12 are not shown for purposes of simplicity. Support 14 includes a member made of ¼" by 1" steel which is bent to form an end flange 26, a lower support arm 28 which is about 15 inches in length, a flange 30, and an upper support arm 32 which includes an upper support extension 34 vertically spaced about six inches above lower support 28. A mounting rod 36 is welded to upper support extension 34. Mounting rod 36 is arranged to be connected to a harness such as a Pearl SD Mag Carrier Model PEMSG2. Likewise, end flange 26 will engage a lower portion of the harness and connect thereto. Support 14 is mounted by flange 30 to the central portion 18 of frame 12 by bolts.

Figure 4:
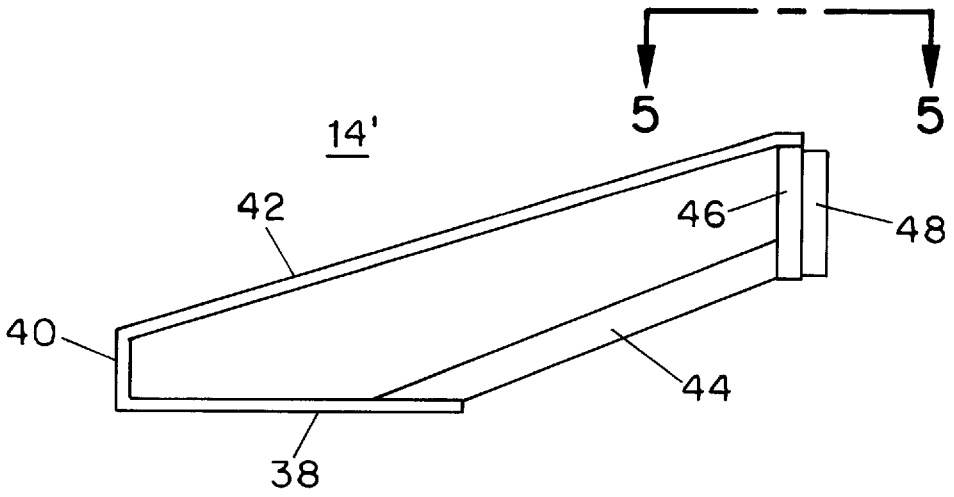
FIG. 4 is a side view of an alternate support member.
Figure 5:
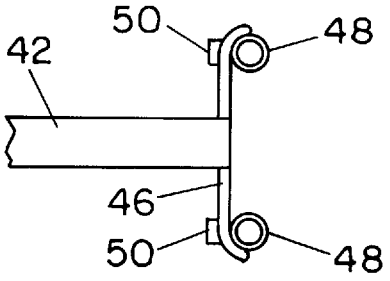
FIG. 5 is a partial top view of the FIG. 4 support member.

An alternate support 14', which is arranged for use with a Pearl DB Vest Carrier/harness, is shown in the side view of FIG. 4 and partial top view of FIG. 5. The support 14' includes a ¼" by 1" steel member which is bent to form lower support portion 38, flange 40 and upper support arm 42. An angle support member 44, which is formed of 1" square steel tubing is connected between lower support portion 38 and flange 46. The combination of lower support portion 38 and angle support member 44 form a lower support arm spaced vertically below upper support arm 42. The upper end of flange 46 is welded to the end of upper support arm 42. As shown in detail in FIG. 5, flange 46 is provided with tube members 48 for engaging corresponding rods on the Vest Carrier. Nuts 50 are welded to flange 46 to provide for set screw engagement, for example, using wing bolts, to the carrier rods.

Figure 3:
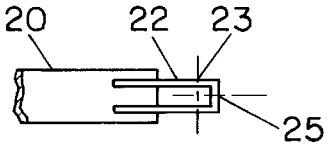
FIG. 3 is another cross-sectional view of the FIG. 1 marching rack showing an instrument mounting member.

FIG. 3 shows details of instrument mounting members 22, which are provided with square through holes 23 for receiving a vertical instrument mounting rod and perpendicular threaded holes 25 for accommodating a wing bolt set screw.

While there has been described what are believed to be the preferred embodiments, those skilled in the art will recognize that other and further modifications may be made thereto without departing from the spirit of the invention and it is intended to claim all such changes and modifications as full within the true scope of the invention.

I claim:

1. A marching rack for percussion instruments, arranged to be carried by a support harness worn by a musician, comprising:

a support member having first and second vertically spaced support arms and having at least one harness connecting member arranged to be connected to said support harness, said support member having an outer end comprising a substantially vertical flange extending between and connecting said vertically spaced support arms; and a bow-shaped frame member, having a central section connected to said flange of said support member, said frame member having first and second side sections extending outward from said central section and rearwardly in the direction of the support harness worn by the musician when said support member is connected to the support harness to form a bow shape, said frame member having a plurality of members spaced along said frame member for individually mounting instruments.

2. A marching rack as specified in claim 1 wherein said first and second support arms each include a harness connecting member.

3. A marching rack as specified in claim 1 wherein said first and second support arms are joined to a common harness connecting member.

4. A marching rack as specified in claim 3 wherein said common harness connecting member comprises a flange having vertical tubes mounted thereon.

5. A marching rack as specified in claim 1 wherein said central section and said first and second side sections are substantially straight and are connected at angles to form said bow shape.

6. A marching rack as specified in claim 1 wherein said central section and said first and second side sections form a substantially continuous curve.

* * * * *